US005122022A

United States Patent [19]

Kluser

[11] Patent Number: 5,122,022

[45] Date of Patent: Jun. 16, 1992

[54] FASTENING ELEMENT FOR SECURING INSULATING STRIPS AND/OR INSULATING BOARDS TO A SOLID BASE STRUCTURE

[75] Inventor: Remo Kluser, Altstätten, Switzerland

[73] Assignee: SFS Stadler Holding AG, Heerbrugg, Switzerland

[21] Appl. No.: 654,601

[22] PCT Filed: May 28, 1990

[86] PCT No.: PCT/EP90/00854

§ 371 Date: Apr. 3, 1991

§ 102(e) Date: Apr. 3, 1991

[87] PCT Pub. No.: WO90/15206

PCT Pub. Date: Dec. 13, 1990

[30] Foreign Application Priority Data

Jun. 9, 1989 [AT] Austria ..... 1428/89

[51] Int. Cl.[5] ..... F16B 15/00; F16B 15/02

[52] U.S. Cl. ..... 411/446; 411/451; 411/384; 411/480; 52/512

[58] Field of Search ..... 411/383, 384, 405, 446, 411/447, 451, 456, 469, 480, 342, 546; 52/410, 512

[56] References Cited

U.S. PATENT DOCUMENTS

| | | | |
|---|---|---|---|
| 1,293,865 | 2/1919 | Mueller | 411/405 |
| 1,458,956 | 6/1923 | Sayer | 411/405 |
| 2,376,936 | 5/1945 | Pfeffer . | |
| 3,909,907 | 10/1975 | Davis | 411/546 |
| 4,630,983 | 12/1986 | Fischer | 411/447 |
| 4,809,477 | 3/1989 | Gasser | 411/342 |
| 4,828,445 | 5/1989 | Giannuzzi | 411/451 |
| 4,881,861 | 11/1989 | Hewison | 411/383 |
| 4,963,062 | 10/1990 | Giannuzzi | 411/446 |

FOREIGN PATENT DOCUMENTS

| | | | |
|---|---|---|---|
| 286706 | 10/1988 | European Pat. Off. | 411/384 |
| 8908118 | 10/1989 | Fed. Rep. of Germany . | |
| 2400599 | 3/1979 | France . | |
| 2620175 | 3/1989 | France . | |

*Primary Examiner*—Neill R. Wilson
*Attorney, Agent, or Firm*—Helfgott & Karas

[57] ABSTRACT

A fastening assembly for securing insulating sheetings or boards to a solid base has a tubular extension secured to a large surface washer at the top end thereof, a nut securely held against rotation in the interior of the tubular extension and an elongated fastener inserted at its top end in to the tubular extension and locked by the nut and which is engaged at its lower end which has a bulge, in the solid base.

4 Claims, 2 Drawing Sheets

Figure 1:
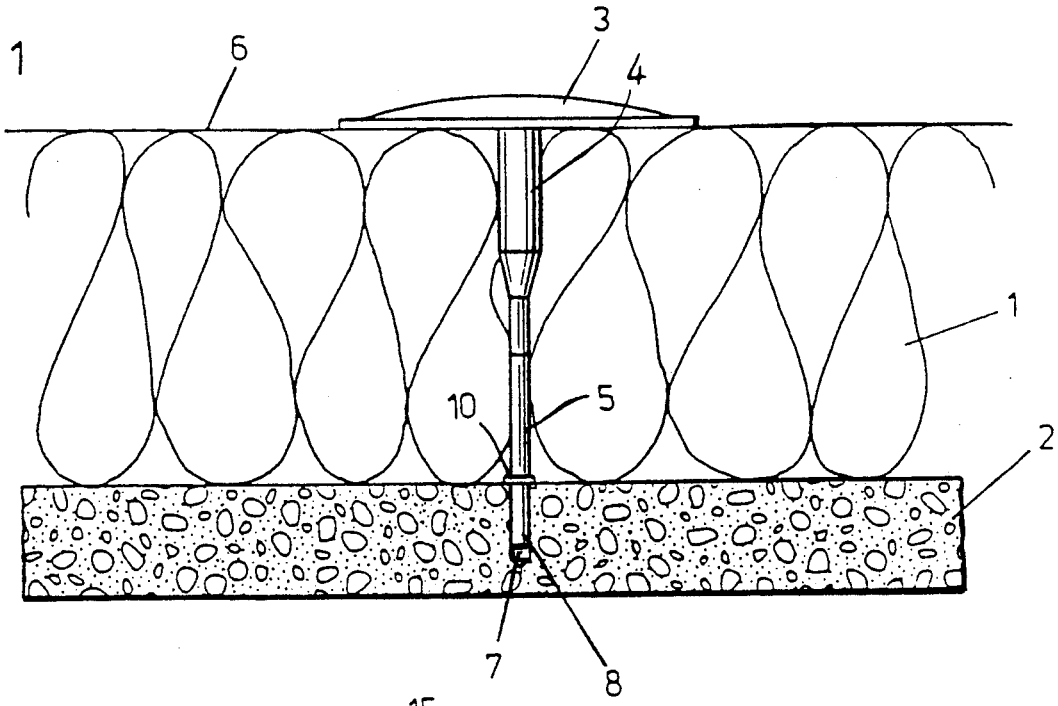

FASTENING ELEMENT FOR SECURING INSULATING STRIPS AND/OR INSULATING BOARDS TO A SOLID BASE STRUCTURE

The invention relates to a fastening element for fixing insulating sheetings and/or boards to a solid base, having a large-area washer and a tubular extension for the passage and guidance of a fastener engaging in the solid base.

Such fastening elements are used for fastening insulating materials to a solid foundation, as for example in fastening insulating boards to roofs. When materials must be transported to a roof, it may happen that a worker, for example, steps on or near a washer, or that a vehicle or tools ride over the washer. Such locally concentrated forces may cause the free end of the fastener to push through the applied seal, or the washer to push through the roofing applied on the insulating material. A design has already been proposed wherein a tubular extension, in which a bolt is inserted, is arranged on the relatively large-area washer. There the head of the bolt lies within this tubular extension and is arranged relatively deeply countersunk with respect to the upper side of the washer, so that the required bolt length is substantially reduced. The thickness of the insulating materials to be attached can therefore be spanned by the combined effect of the length of the tubular extension and the length of the bolt. In this connection, it has likewise been known that the washer and the tubular extension may be made of two separate parts. In both known designs the possibility exists that the whole fastening element, in the event of loading, may telescope when, for example, a person steps on the washer.

However, in the known designs it is disadvantageous that, depending upon the thickness of the insulating sheetings and/or boards and especially with unlike thickness of the sheetings on a roof, a plurality of different lengths of fasteners, i.e., as a rule bolts, is required, since in the previous design the bolt head must come to rest on the floor of the interior of the tubular extension, since the tubular extension and the washer must be pressed against the upper side of the sheeting. When it does not matter how far such a bolt is screwed into the solid base, this plays less of a role. When the solid base consists, for example, of concrete slabs or of wood with a decorative covering, these bolts cannot be inserted indefinitely far into such base.

The object of the invention, therefore, was to procure a fastening element by which, in a relatively great region, equalization with reference to the thickness of the insulating sheetings is possible, while a telescopic movement between fastener and tubular extension is nevertheless able to take place and the depth of insertion of the fastener in the base cam always remain the same.

This is accomplished, according to the invention, by a fastener having one or a plurality of wave-shaped bulge(s) at its one end region, which fastener is capable of being driven into a prepared hole in the solid base, the end region of the fastener projecting into the tubular extension being provided with a thread, and a bolt nut capable of being introduced through the interior of the tubular extension and screwed onto this end region of the fastener.

In the design according to the invention, therefore, a bolt with a bolt head is no longer used but, rather, a fastener which projects into the interior of the tubular extension and is fixed there by a bolt nut screwed onto it. This makes it possible to place the nut, acting as a locking element, so that the tubular extension and, hence, the large-area washer as well, are fixed in a position in which they are pressed on the upper side of the insulating sheetings and/or boards. Depending upon the thickness of the insulating sheetings and/or boards, the corresponding end region of the fastener will therefore project more or less far into the tubular extension, the special design making tightening or readjustment possible at any time. The fastener, which is driven into a hole in the base, can thus always be inserted into the base to the same extent. Now, whether the insulating sheetings are equally thick over the whole roof, or whether, for example, they taper toward one marginal edge, no longer plays any role; the fasteners of equal length can practically always be used, although they need not be driven further into the base. The length of the tubular extension suffices to equalize these differences in thickness and nevertheless permit a telescopic movement between the tubular extension and the fastener.

The special design of the fastener at its driving end makes it eminently suitable for application pursuant to the invention. Here a hole can be prepared which is designed for a close fit with respect to the corresponding end of the fastener. When the fastener is driven in, the wave-shaped bulge necessarily deforms the end region to be driven in, specifically, because the latter again assumes its original cylindrical shape, so that this form-and and force-locking connection ensures optimal security against tearing out.

However, a structurally simple embodiment is alternatively obtained when the end region of the drivable fastener projecting into the tubular extension is provided with a thread and locking is effected by the nut which can be inserted into the interior of the tubular extension. It is then possible to tighten the nut more or less, depending upon the thickness of the insulating sheetings, as required to produce proper contact of the washer on the upper side of the insulating sheetings.

Figure 2:
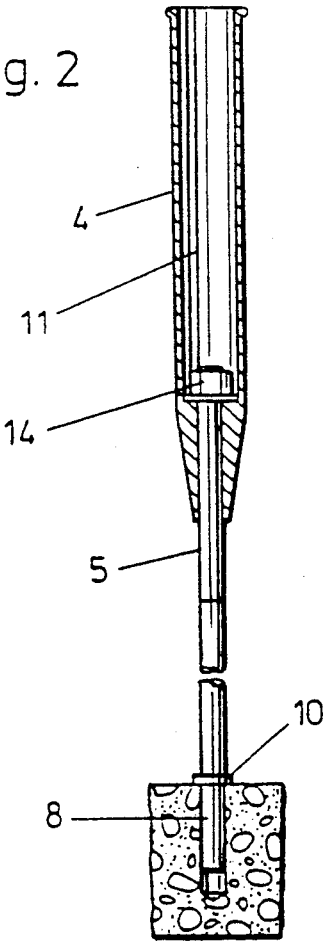
Figure 3:
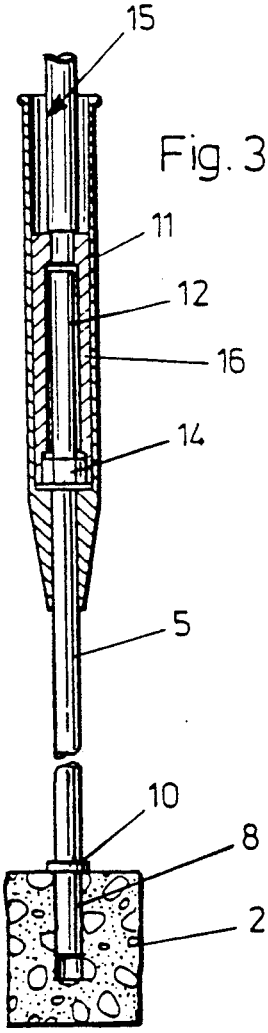
Figure 4:
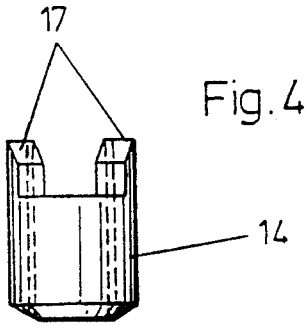
Figure 5:
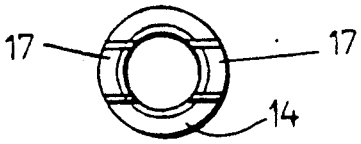
Figure 7:
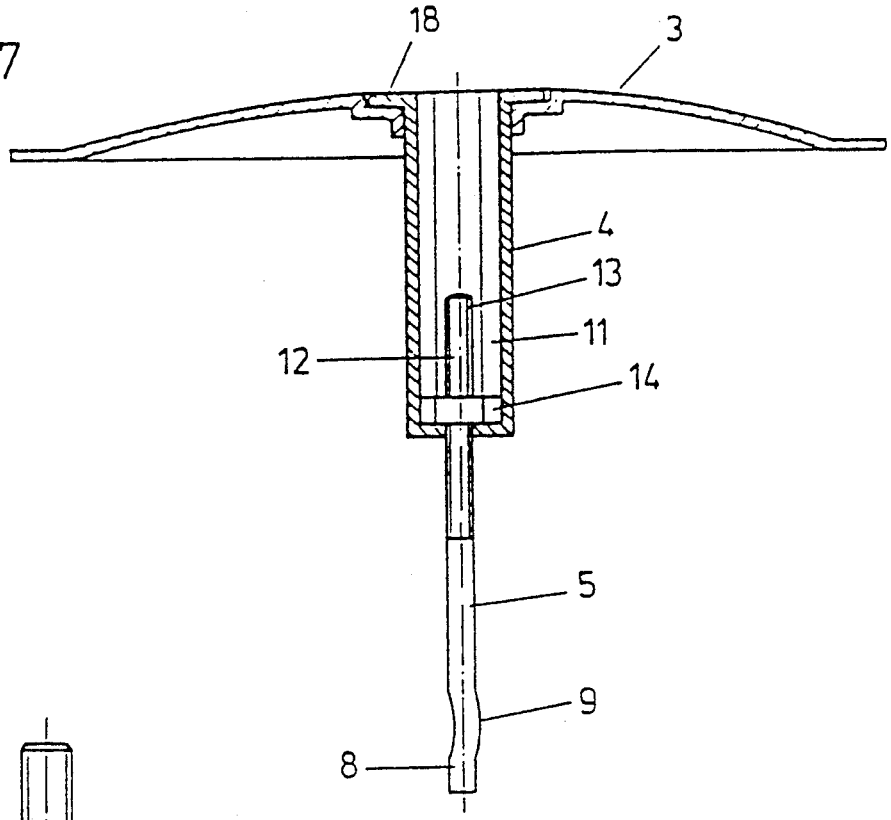
Figure 6:
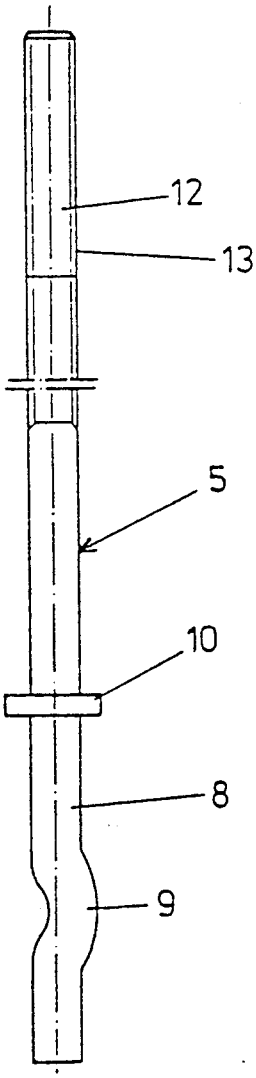
Figure 8:
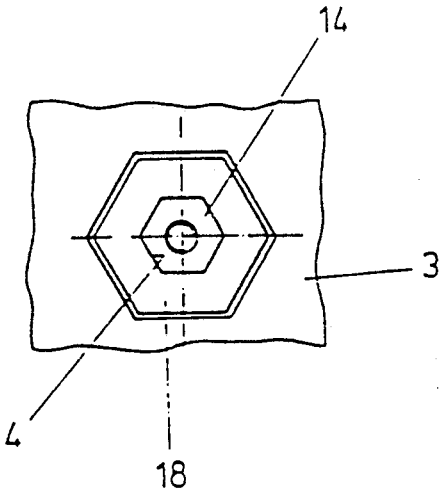

Additional features according to the invention and special advantages are explained in greater detail in the description below with the aid of the drawings, wherein FIG. 1 shows a section through a solid base with insulating sheeting applied and a fastening element according to the invention;

FIG. 2, a section through the tubular extension with fastener inserted, shown enlarged with respect to FIG. 1;

FIG. 3, the same illustration as FIG. 2, but where the end region of the fastener projects further into the tubular extension;

FIGS. 4 and 5, in side view and top view, a special embodiment of a nut attachable to the fastener;

FIG. 6, an enlarged representation of a fastener, as it is used in the embodiments of FIGS. 1 to 3;

FIG. 7, a section through a fastening element according to the invention;

FIG. 8, a top view of a partial region of the fastening element, the nut attached to the fastener in this embodiment being designed to offer protection against turning.

FIG. 1 shows an example of how insulating sheetings 1 are fastened to a solid base 2. A fastening element, which has a large-area washer 3 with a tubular extension 4, is used for this purpose. By means of a fastener 5, which is inserted in the solid base 2, the large-area washer 3 is pressed by way of the tubular extension 4 on the upper surface 6 of the insulating sheeting 1. The washer 3 and the tubular extension 4 are preferably made of separate parts and may therefore alternatively be made of unlike materials. Merely for reasons of preliminary storage, it is preferable to store the fastener 5 and the tubular extension 4 together and to stack the washers 3 separately. Since the free end region of the fastener 5 projects into the interior of the tubular extension 4, a telescopic displacement of the tubular extension 4 and the corresponding end region of the fastener 5 is possible, so that loads from treading on the washer 3 can be absorbed without any problem.

The base 2 in the illustration of FIG. 1 consists of a concrete slab. Holes 7, into which the ends 8 of the fasteners 5 are then driven, are made in this slab. In this special design of the fastener 5 the driving end 8 has an essentially smooth surface, but at least one bulge 9, this bulge 9 offering a sufficient form-and force-locking hold in the base 2 made of concrete. A stop collar 10 ensures that the driving end 8 is always driven into the hole 7 to the same depth, which is of special importance precisely in a relatively thin-walled concrete base. Accordingly, such a design allows fasteners 5 to be driven directly into a base 2 formed of concrete.

The design of the fastening element according to the invention is thus of considerable importance wherever only a particular screw-in or drive-in depth of the fastener is possible or desired, since it is nevertheless essentially possible to use the fasteners 5 of equal length, inasmuch as they are able to project more or less far into the tubular projection 4. To accomplish this object, a locking element in the form of a nut, engaging on the fastener 5, is attachable in the end region 12 of the fastener 5 projecting into the interior of the tubular extension 4.

The end region 12 of the fastener 5 projecting into the tubular extension 4 is provided with a thread 13. A nut 14 is capable of insertion through the interior 11 of the tubular extension 4 and can be screwed onto the end region 12 of the fastener 5.

In FIG. 3 it can be seen that a special tool 15 for tightening the nut 14 may be provided, this tool 15 having a corresponding socket 16 for the protruding region of the end region 12 of the fastener 5. In this design of the nut 14 as a hexagonal head cap screw, the tool must be able to engage over the side regions of this nut 14. When, on the other hand, a design of a nut 14 as it is shown in FIGS. 4 and 5 is used, the nut 14 may either be executed in a greater thickness or else the tubular extension 4 may be made slenderer. In this design of a nut 14 of FIGS. 4 and 5, tool application elements 17, projecting parallel to the axis, are provided, to which a suitable tool for turning this nut 14 may be applied.

In this connection, it is alternatively advantageous when security against turning is provided for the nut 14, specifically, so that the nut 14 is held secure against turning in the tubular extension 4. This may be accomplished in that, for example (see FIGS. 7 and 8), a preferably multiangular outer contour of the nut 14 corresponds to approximately the cross section of the interior 11 of the tubular extension 4. When the nut 4 is screwed in, the tubular extension 4 is turned along with it, or else the tubular extension 4 may be turned with a suitable tool, for example, a wrench, whereby the nut 14 is then likewise turned owing to the form-locking connection. Due to the relatively great surface of the tubular extension 4, the latter already has a great frictional surface with respect to the insulating material surrounding it, so that a certain degree of security against turning is provided. However, it is advantageous to make the tubular extension 4 even more secure against turning with respect to the large-area washer 3, so that the nut 14 is securely prevented from loosening. A variant embodiment is shown in FIGS. 7 and 8. Here a corresponding depression is provided in the washer 3 to accommodate the closure edge 18 of the tubular extension 4, the shape of the closure edge 18 and the depression in the washer 3 being designed alike. In the embodiment shown, a hexagonal shape has been selected. Hence protection against turning between the tubular extension 4 and the washer 3 is likewise ensured, so that the great resultant friction is with certainty able to prevent loosening of the nut 14. It is alternatively possible, within the scope of the invention, to employ other design measures to secure the tubular extension 4 and the washer 3 against turning. Thus, for example, the closure edge 18 could be designed elliptical, triangular or multiangular or with projections which then engage in corresponding depressions or recesses of the washer 3. The design of the tubular sleeve 4 may alternatively be executed in any desired cross section, specifically, matching the outer contour of the nut 14, while the nut 14 naturally need not fit tightly against the inner wall of the tubular sleeve 4 to prevent turning.

The present invention hence makes it possible to use fasteners of equal length essentially everywhere for attaching insulating sheetings and/or boards on a solid base, even though such fasteners are driven into the base 2 to a constant depth in each instance. Thus the relatively simple design measures have provided an optimal opportunity which, particularly in the case of inclined roofs, where the insulating material formed of insulating sheetings and/or boards ends tapered, gives excellent results. Therefore an adjustment from the top, i.e., through the tubular extension, is always possible.

I claim:

1. Fastening element for securing insulating strips and boards to a solid base, comprising a large surface area washer, a fastener, a tubular extension for a passage and guidance of said fastener engaged in the solid base, said fastener (5) having at least one wave-shaped bulge (9) at one end region thereof, said fastener being capable of being driven into a prepared hole in the solid base, another end region of the fastener (5) projecting into the tubular extension (4) and being provided with a thread (13), and a nut (14) attachable to said another end region (12) of the fastener (5), said another end region being insertable into an interior (11) of the tubular extension (4), said tubular extension being connected to said washer so as to secure said tubular extension against rotation, said tubular extension and said nut being formed so that said nut is held secure against rotation in said tubular extension and so as to permit a telescopic movement of said fastener relative to said tubular extension.

2. Fastening element according to claim 1, wherein the fastener (5) has a stop collar (10) connected to a portion (8) of said fastener insertable in the solid base.

3. Fastening element according to claim 1, wherein said nut has a polygonal outer contour which substantially corresponds to a cross section of the interior (11) of the tubular extension (4).

4. Fastening element according to claim 1, wherein the nut (14) forms a locking element and is provided with gripping elements (17) projecting parallel to an axis of said nut for a tool.

* * * * *